US005333791A

United States Patent [19]

Carlo

[11] Patent Number: 5,333,791

[45] Date of Patent: Aug. 2, 1994

[54] NOZZLE FOR EMISSION OF A MIXTURE OF WATER AND AIR FOR HYDROMASSAGE

[75] Inventor: Leoni Carlo, Milan, Italy

[73] Assignee: American Standard Inc., New York, N.Y.

[21] Appl. No.: 80,426

[22] Filed: Jun. 21, 1993

[30] Foreign Application Priority Data

Jun. 29, 1992 [IT] Italy ..... RE92 U 000056

[51] Int. Cl.[5] ..... A61H 33/02

[52] U.S. Cl. ..... 239/428.5; 239/424; 239/571; 239/587.4; 4/541.6

[58] Field of Search ..... 239/428.5, 425.5, 423-424.5, 239/570-572, 587.4; 4/541.3-541.6

[56] References Cited

FOREIGN PATENT DOCUMENTS

| | | | |
|---|---|---|---|
| 0168823 | 1/1986 | European Pat. Off. | 4/541.6 |
| 0311967 | 4/1989 | European Pat. Off. | 4/541.6 |
| 0372642 | 6/1990 | European Pat. Off. | 4/541.6 |
| 0455088 | 11/1991 | European Pat. Off. | 4/541.6 |

*Primary Examiner*—Karen B. Merritt

*Attorney, Agent, or Firm*—Elaine Brenner Robinson; Ann M. Knab

[57] ABSTRACT

An improved nozzle for emission of a mixture of water and air for hydromassage capable of being fixed to the wall of a tub which comprises an inner housing with the possibility of rotation lodged within an outer housing fixed to an opening in the tub. On the housing is fixed an inner duct facing the tub, the inner housing being united to a tubular member that communicates with a first chamber and having its own anterior mouth arranged inside of the inner duct. To the mouth is applied a one-way valve capable of closing the passage through the mouth when the pressure in the space anterior to the mouth is greater than the pressure in the posterior space. In the inner duct is placed a tubular obturator having an axial cavity within which is placed the anterior mouth of the tubular member, and having an intermediate section capable, after contact with the outer surface of the intermediate portion, of closing off communication between the second chamber and the anterior mouth of the inner duct. The obturator is normally held in closure position by a coil spring and is capable of undergoing axial displacements due to a pressure difference between the spaces upstream and downstream from the intermediate section.

4 Claims, 2 Drawing Sheets

NOZZLE FOR EMISSION OF A MIXTURE OF WATER AND AIR FOR HYDROMASSAGE

BACKGROUND OF THE INVENTION

The present invention relates to a nozzle for emission of a mixture of water and air into a tub for hydromassage. As is known, a tub for hydromassage comprises an ordinary bathtub equipped at the walls with nozzles supplied by a system drawing water from the tub which is previously filled. The water is than mixed with air, and reintroduced, under pressure, into the tub through the nozzles. Since the tub, though equipped with the hydromassage system, will also serve for ordinary bathing to cleanse the body, it is important that the nozzles do not permit any leakage of water into the circuit of the system when the hydromassage system is idle. If standing water, mixed with matter carried off from the user's skin, leaks into the hydromassage system, mold and bacteria may begin to grow and may get recirculated on the occasion of hydromassage.

The nozzle should also be capable of being oriented at will so that the jet of air and water may be directed in any desired manner. Such nozzles must perform the function of drawing in air from the outer surroundings and mixing it into the jet of water under pressure so that the hydromassage may be performed with a mixture of air and water. It is important that the skin of the body be struck by air bubbles so as to undergo not only a massaging effect but also an effective oxygenating action. Presently, there are nozzles that are known that will satisfy the above mentioned requirements and functions, but they are complicated and costly in construction, and moreover are in need of improvement with regard to being hermetically sealed when the hydromassage system is not in use.

SUMMARY OF THE INVENTION

It is therefore an object of the present invention to provide a nozzle capable of satisfying the requirements and functions mentioned above, but giving better results than known nozzles, and at the same time being capable of simple and low-cost construction.

BRIEF DESCRIPTION OF THE DRAWINGS

The invention will be set forth in detail in the following description with the aid of the accompanying figures illustrating an embodiment thereof.

DETAILED DESCRIPTION OF THE PREFERRED EMBODIMENTS

Figure 1:
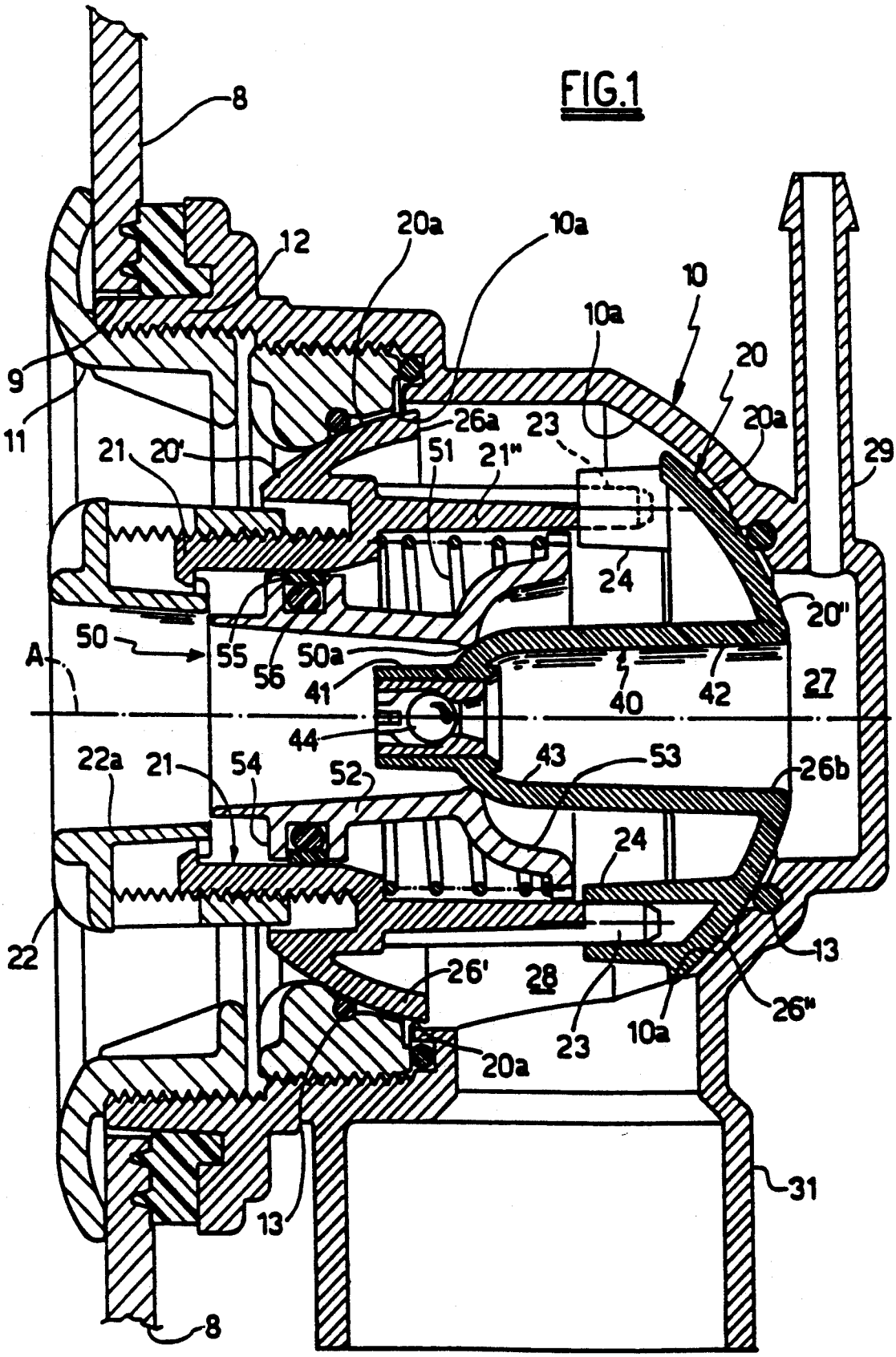
FIG. 1 is a sectional view of the nozzle according to the invention, at a vertical axial plane, in closed configuration.
Figure 3:
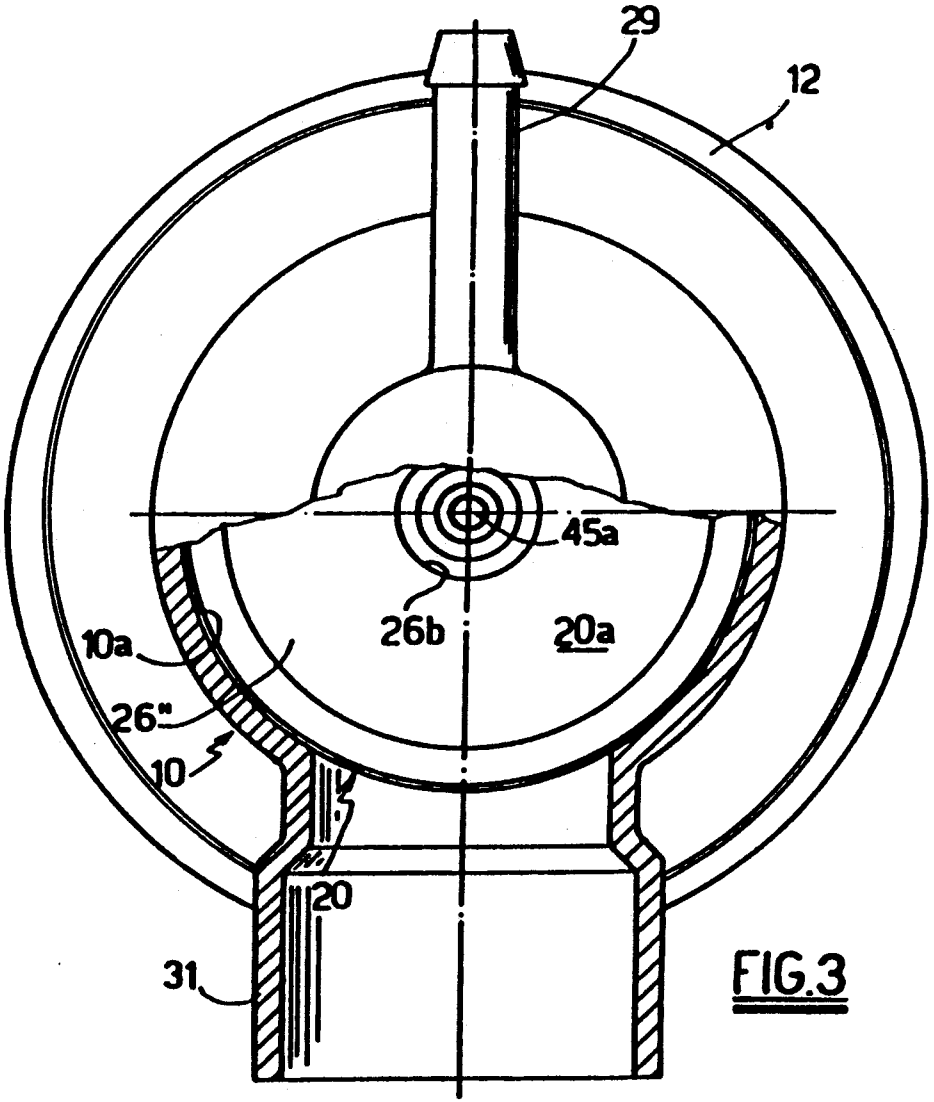
FIG. 3 is a rear view of FIG. 1 with some parts removed.

The nozzle comprises an outer housing 10 and an inner housing 20. The outer housing 10 is generally cup-shaped and capable of being fixed by means of a rim 11 screwed onto the mouth 12 of the housing 10 to an opening 9 made in a wall 8 of the tub to which the hydromassage system is applied. The housing 10 has a concave and roughly spherical inner surface 10*a*, generally facing the inner space of the tub.

The inner housing 20 has outer walls 26' and 26'' defining a convex and roughly spherical outer surface 20*a* fitted within the surface 10*a* of the housing 10. The coupling between the two housings 10 and 20 is such that the housing 20 is secured to the housing 10 and yet can vary its own orientation by rotation in any plane of the space surrounding the geometrical center of the spherical surfaces 10*a* and 20*a*. The seal between the two surfaces 10*a* and 20*a* is provided by annular packings 13 compressed between the two surfaces, 10*a* and 20*a*.

The inner housing 20 has an inner duct 21 with centerline A, facing the interior of the tub through the mouth 12. To the anterior end of the duct 21 is screwed an annular member 22 defining the anterior mouth of the duct 21. The member 22 has an annular portion 22*a* tapering inward with respect to the duct 21. Member 22 serves as an impact shield, and has an aesthetic function as well.

For structural reasons, the inner housing 20 is made in two separate parts, 20' and 20'' joined together by rods 23 integral with part 20' and forced into cylindrical recesses 24 integral with part 20''. The duct 21 is connected to the wall 26' and has an anterior segment 21' and a posterior segment 21'' with the posterior end being free. Rods 23 are joined to posterior end 21''.

The outer wall 26' forms part of 20', and the other wall 26'' forms part of 20''. The two walls 26' and 26'' are distant from each other so as to define an annular opening 26*a* extending circumferentially around the centerline A.

The housing 20 in combination with the housing 10 defines a posterior first chamber 27 in communication with an air supply duct 29 that is in communication with the outer surroundings. A second chamber 28 is also defined at the opening 26*a* whereat a lower water supply duct 31 discharges. This chamber 28 provides communication between the duct 31 and the anterior mouth 22 through the passage left between the cylindrical sleeves 24 and between the free end of the duct segment 21'' and the wall 26''.

Inside the inner housing 20 is provided a tubular member 40 joined at its own posterior end to the posterior wall 26'' of the housing 20, an opening 26*b* being there provided, communicating between the interior of the member 40 and the chamber 27. The member 40 is coaxial with A and has an anterior mouth 41 arranged inside the duct 21.

The anterior mouth 41 has an outside diameter smaller than the outside diameter of the posterior portion 42 of member 40 and is connected to portion 42 by an intermediate portion 43 having a convex and rounded outer profile. Inside the duct 21 is placed a tubular obturator 50 having an interior coaxial with A, in which is placed the anterior mouth 41 of the tubular member 40. The obturator 50 has an anterior portion 52 by which it is coupled and sealed to the cylindrical inner surface of segment 21' of duct 21, but capable of sliding axially. The tubular obturator 50 has an intermediate section 50*a* whose inner surface is normally held by an elastic means, such as a coil spring 51, against the outer surface of the intermediate portion 43, the inside diameter of section 50*a* being smaller than the greatest diameter of portion 43.

The anterior portion 52 of the obturator 50 is in the shape of a truncated cone diverging towards the anterior end. The posterior portion 53 is flared in a bell shape and surrounds the posterior portion 42 of tubular member 40, which together define an annular cavity with a cross-section diverging slightly towards the posterior end. The intermediate section 50*a* is defined by the connecting section between the anterior portion 52 and the posterior portion 53.

An annular seat 54 is formed on the outer surface of the anterior portion 52 and is open in the radial direction towards the exterior, in which is lodged an annular antifriction packing piece 55 pressed into contact with the inner surface of segment 21' of duct 21 by a thrust ring 56. The packing piece 55 makes a seal against said inner surface of the segment 21' through axial sliding.

Figure 2:
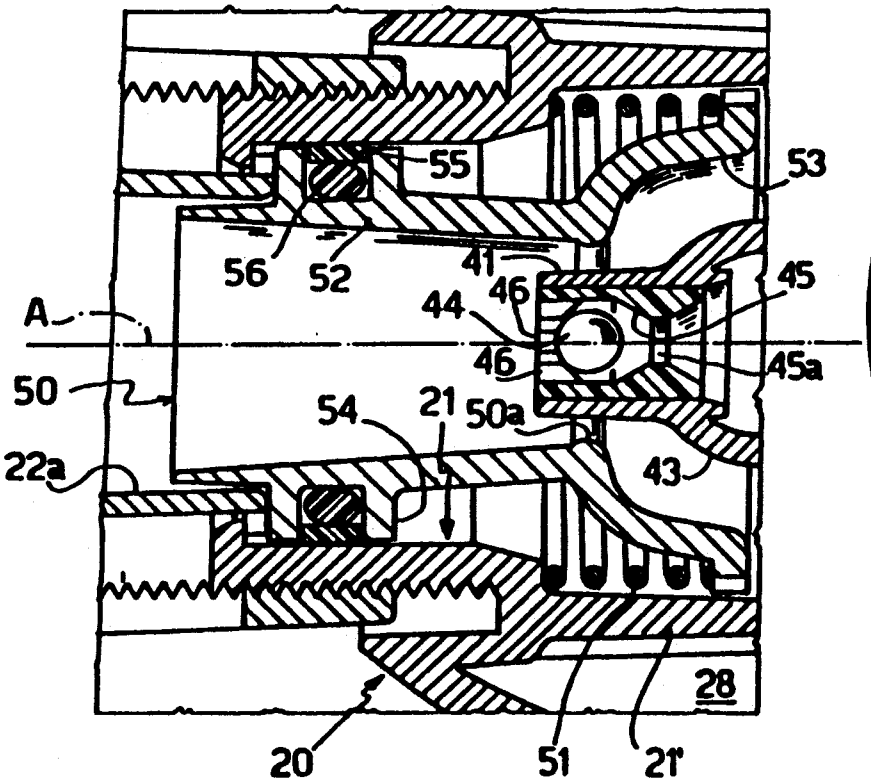
FIG. 2 is a detailed view of the nozzle of FIG. 1 in open configuration, allowing passage of the air-water mixture.

The axial sliding of obturator 50 inside duct 21 gives rise to a closed position when the intermediate section 50*a* is in contact and sealed against the intermediate portion 43 (as shown in FIG. 1), and in open position when the intermediate section 50*a* is shifted forward and not in contact with the intermediate portion 43 (as shown in FIG. 2). In this closed position, communication between chamber 28 and anterior mouth 22 is blocked, whereas such communication is open when obturator 50 is in the open position.

In addition to being subjected to an axial thrust of the spring 51, the obturator 50 is also apt to undergo axial displacement due to a possible pressure difference between the spaces upstream and downstream from said intermediate section 50*a*. This is a result of the diameter of the section where there is sealing contact between the anterior portion 52 and the inner surface of the duct 21 (or the inside diameter of the segment 21'), being greater than the diameter of the intermediate section 50*a*. Therefore, an axial thrust surface is defined on obturator 50 which area is equal to that of a circular annulus with the outside diameter equal to the outside diameter of the segment 21' and the inside diameter equal to the diameter of the intermediate section 50*a*.

To the anterior mouth 41 of the tubular member 40 is applied a one-way valve means capable of closing the passage through mouth 41 when the pressure in the space anterior to mouth 41 is greater than the pressure in the posterior space. In particular, this valve means comprises a spherical obturator 44 lodged in the cavity of the mouth 41. Mouth 41 has a posterior taper seat 45 for ball 44, seat 45 providing an opening 45*a* for the passage of air. Furthermore, anterior radial elevations 46 are provided near the anterior end to retain ball 44, leaving the air passage open. The diameter of ball 44 is smaller than the diameter of the cavity of mouth 41, and ball 44 is capable of closing the passage opening 45*a* with a seal by resting against seat 45.

When the hydromassage system is not in operation and the tub is full, spring 51 keeps obturator 50 continually thrust against tubular member 40, preventing the water present inside mouth 22 and inside anterior portion 52 from leaking into second chamber 28 and not passing beyond intermediate section 50*a*. This seal is rendered yet more hermetic by the presence of the water in the tub, which acts on the thrust surface defined by obturator 50. Therefore, there is no pressure in chamber 28 to oppose the thrust of the water in the tub, which thrust acts in the direction of thrusting obturator 50 against member 40. At the same time, the thrust of the water with which the tub (and portion 52) is filled, holds ball 44 pressed against seat 45 and hermetically seals opening 45*a*. Therefore, the water in the tub will not leak beyond seat 45 either.

When the pump of the hydromassage system goes into operation, it draws water from the tub and passes it under pressure through duct 31 into chamber 28, where it arrives in the space between member 40 and posterior portion 53 of obturator 50. This water also enters the annular space defined between the outer surface of obturator 50, posterior to the packing 55, and the inner surface of segment 21" of duct 21. Hence, owing to the higher pressure of the water present in chamber 28, the thrust of spring 51 is overcome as well as the thrust of the water in the space anterior to section 50*a*, and obturator 50 is displaced forward, thus permitting the water to exit from chamber 28 to the interior of the tub. This open position is then maintained also owing to the dynamic action of the water in the segment of passage defined between portion 53 and portion 42, which may advantageously be convergent in the direction of motion of the water. As a result, a jet of water passes through the axial cavity of obturator 50 at considerable speed, directed towards the tub.

This jet of water, owing to its comparatively high velocity when it passes alongside anterior mouth 41 (by way of the comparatively reduced passage cross-section in the space provided between intermediate section 50*a* and tubular member 40), produces an effect of aspiration lifting ball 44 from seat 45 and drawing air from chamber 27. Ball 44 is pulled against anterior elevation 46. As a result, at the anterior end of mouth 41, there is a mingling of the air coming from the atmosphere through chamber 27 with the water pumped by the hydromassage system.

Although illustrative embodiments of the present invention have been described herein with reference to the accompanying drawings, it is to be understood that the invention is not limited to those precise embodiments, and that various other changes and modifications may be effected therein by one skilled in the art without departing from the scope or spirit of the invention.

What is claimed is:

1. An improved nozzle for emission of a mixture of water and air for hydromassage, capable of being fixed to a wall of a tub, comprising:

an outer housing capable of being fixed to a hole in the wall of the tub, said outer housing having a concave and substantially spherical inner surface facing the inside of said tub;

an inner housing having a convex and substantially spherical outer surface fitted within said inner surface of said outer housing so that the orientation of said inner housing with respect to said outer housing can be varied, said inner housing having an inner duct opened towards the interior space of the tub, said inner housing in combination with said outer housing defining a posterior first chamber in communication with an air supply duct, and a second lateral and annular chamber separated from said first chamber, said second chamber in communication with a water supply duct and an anterior mouth of said inner duct;

a tubular member joined to said inner housing and communicating posteriorly with said first chamber, said tubular member having an anterior mouth arranged inside said inner duct, said anterior mouth of said tubular member having an inside and outside diameter smaller than the inside and outside diameter respectively, of a posterior portion of said tubular member, the diameter of said tubular member decreasing sharply from said posterior portion to said anterior mouth, and said anterior mouth of said tubular member and said posterior portion being connected by an intermediate portion;

a one-way valve means applied to said anterior mouth of said tubular member capable of closing the passage through said mouth of said tubular member when the pressure in the space anterior to said mouth of said tubular member is greater than the pressure in an interior space of said posterior portion, said one-way valve means comprising a spherical obturator lodged inside a cavity of said anterior mouth of said tubular member, said anterior mouth of said tubular member having a posterior tapered seat for said spherical obturator, said posterior tapered seat defining an air passage hole, and said anterior mouth of said tubular member also having radial anterior elevations to retain said spherical obturator, said spherical obturator having a diameter smaller than the diameter of said cavity of said anterior mouth of said tubular member and being capable, by resting against said seat, of closing said passage hole; and a tubular obturator slidable with a seal inside said inner duct.

2. The nozzle according to claim 1, characterized in that said obturator has an axial cavity in which is placed said anterior mouth of said tubular member and an intermediate section capable, after contact with the outer surface of said intermediate portion of said tubular member, of closing off communication between said second chamber and said anterior mouth of said inner duct, said obturator being normally thrust into closed position by an elastic means and being capable of undergoing axial displacements due to a pressure difference between the spaces upstream and downstream from said intermediate section.

3. The nozzle according to claim 2, characterized in that the diameter of the section of said tubular obturator whereat it contains said seal is greater than the diameter of said intermediate section of said tubular obturator so as to define an axial thrust surface for said obturator.

4. The nozzle according to claim 1, characterized in that said tubular obturator has an anterior portion of shape diverging towards the anterior end and a posterior portion flared into a bell shape and surrounding said posterior portion of said tubular member, said tubular obturator in combination with said tubular member defining an annular cavity of cross section diverging towards the posterior end, an intermediate section of said tubular obturator being defined by the connecting section between said anterior portion and said posterior portion.

* * * * *